US011029111B2

(12) United States Patent
Dagher et al.

(10) Patent No.: US 11,029,111 B2
(45) Date of Patent: Jun. 8, 2021

(54) FIREARM BARREL LOCK

(71) Applicant: SFUS Inc., a Del. Corp., Washington, DC (US)

(72) Inventors: Joseph Dagher, Manchester, NH (US); Kyle Downey, Front Royal, VA (US); Steven Zaleznick, Washington, DC (US)

(73) Assignee: SFUS INC., A DEL. CORP., Washington, DC (US)

( * ) Notice: Subject to any disclaimer, the term of this patent is extended or adjusted under 35 U.S.C. 154(b) by 0 days.

(21) Appl. No.: 16/876,846

(22) Filed: May 18, 2020

(65) Prior Publication Data

US 2020/0386501 A1 Dec. 10, 2020

Related U.S. Application Data

(60) Provisional application No. 62/849,577, filed on May 17, 2019.

(51) Int. Cl.
*F41A 17/44* (2006.01)
*F41A 17/04* (2006.01)

(52) U.S. Cl.
CPC ..... *F41A 17/44* (2013.01); *F41A 17/04* (2013.01)

(58) Field of Classification Search
CPC ..... F41A 17/00; F41A 17/04; F41A 17/44
USPC ..... 42/70.11
See application file for complete search history.

(56) References Cited

U.S. PATENT DOCUMENTS 2,479,107 A * 8/1949 Garretson ..... F41A 17/44 42/76.01
2,887,807 A * 5/1959 Santangelo ..... F41A 17/44 42/70.11
4,398,366 A * 8/1983 Wernicki ..... F41A 17/44 42/70.11
4,512,099 A * 4/1985 Mathew ..... F41A 17/44 42/70.11
4,908,971 A * 3/1990 Chaney ..... F41A 17/44 42/70.11
4,961,277 A * 10/1990 Rosenbaum ..... F41A 17/44 42/70.11
5,048,211 A * 9/1991 Hepp ..... F41A 17/44 42/70.11
5,289,653 A * 3/1994 Szebeni ..... F41A 17/44 42/70.11
5,398,438 A * 3/1995 Williams ..... F41A 17/04 42/70.11

(Continued)

*Primary Examiner* — Joshua E Freeman
(74) *Attorney, Agent, or Firm* — Stein IP, LLC

(57) ABSTRACT

A gun lock has a user manipulatable proximate end and a distal end for insertion into a barrel of a firearm. The distal end is spaced from the proximate end by a distance sufficient to allow the distal end to enter the chamber of the firearm when the proximate end is adjacent to but spaced from the barrel of the firearm. The distal end has elements which respond to user manipulation to transit from a first state allowing the distal end to enter and withdraw from the chamber of the firearm and a second state which prevents the distal end from withdrawing from the chamber. With the distal end of the gun lock inserted into the chamber and then transiting to the second state the inability to withdraw the gun lock from the firearm prevents the firearm from normal use.

10 Claims, 12 Drawing Sheets

(56) References Cited

U.S. PATENT DOCUMENTS 5,491,918 A * 2/1996 Elmstedt ..... F41A 17/44 42/70.11
5,664,358 A * 9/1997 Haber ..... F41A 17/44 42/44
5,699,687 A * 12/1997 Pittman ..... F41A 17/02 42/70.11
5,860,241 A * 1/1999 Waters ..... F41A 17/06 42/66
6,526,684 B1 * 3/2003 Hickerson ..... F41A 17/44 42/70.01
6,560,910 B1 * 5/2003 McLaren ..... F41A 17/04 42/70.11
6,634,130 B1 * 10/2003 Balchunas ..... F41A 17/44 42/70.11
6,701,655 B2 * 3/2004 Milo ..... F41A 17/44 42/70.11
6,862,831 B1 * 3/2005 Canaday ..... F41A 17/44 42/66
6,895,707 B2 * 5/2005 Young ..... F41A 17/44 42/70.11
7,150,122 B1 * 12/2006 Ha ..... F41A 17/44 42/70.11
7,849,625 B2 * 12/2010 Ligard ..... F41A 17/44 42/70.11
9,784,517 B2 * 10/2017 Pittman ..... F41A 17/02
9,803,944 B2 * 10/2017 Pittman ..... F41A 17/02
10,648,754 B2 * 5/2020 Sun ..... F41A 17/44
2001/0034961 A1 * 11/2001 Hickerson ..... F41A 17/44 42/70.11
2002/0133999 A1 * 9/2002 Polenz ..... F41A 17/44 42/70.11
2004/0200114 A1 * 10/2004 Milo ..... F41A 17/44 42/70.11
2006/0162221 A1 * 7/2006 McLaren ..... F41A 17/44 42/70.11
2020/0072570 A1 * 3/2020 Sun ..... F41A 17/06
2020/0386501 A1 * 12/2020 Dagher ..... F41A 17/04

* cited by examiner

FIREARM BARREL LOCK

CROSS-REFERENCE TO RELATED APPLICATIONS

This application claims the benefit of U.S. Provisional Application No. 62/849,577, filed May 17, 2019, in the United States Patent Office. All disclosures of the document named above are incorporated herein by reference.

BACKGROUND OF THE INVENTION

There is a need for a practical, easy to use lock for a firearm. Such a lock will, when engaged prevent discharge of the firearm and when not engaged will allow the use of the firearm without hindrance. The art includes earlier firearm locks, such as McLaren U.S. Pat. No. 6,560,910. The present invention offers substantial advantages over the prior art.

SUMMARY OF THE INVENTION

The present invention is a lock for a firearm which may be inserted into the barrel of the firearm. The firearm includes a chamber adjacent a barrel with the chamber having a diameter which is greater than the diameter of the barrel. The lock of the present invention includes a user manipulatable proximate end and a distal end which responds to the user manipulation by transiting between a lock condition and an unlock condition. The proximate and distal ends of the lock are coupled by a hollow shaft in which a rod is supported. The length of the hollow shaft is sufficient to place the distal end of the lock within the chamber of the firearm when the proximal end extends beyond the length of the barrel. The rod cycles between two positions, in one, a lock condition and the other an unlock condition. The rod cycles in response to user manipulation of the proximate end.

In one embodiment the rod may translate toward the distal end in response to user manipulation of the user manipulatable end. The distal end includes a flexure pawl which extends from the distal end of the rod adjacent an aperture in the hollow shaft. In the unlock condition the flexure pawl presents a surface which exhibits a continuation of the surface of the hollow shaft. The rod includes a first portion, at the extreme distal end, with one diameter and an adjacent portion with a greater diameter. The flexure pawl engages the rod and, as the rod translates toward the distal end, the flexure pawl engages the portion of the shaft of greater diameter. This causes the surface of the pawl to above the surface of the hollow shaft. When this action occurs with the distal end of the lock located in the chamber of the firearm, the motion of the pawl causes the surface of the pawl to engage an interior ridge of the firearm located at the junction of the chamber and barrel. Engagement of the pawl with the ridge of the firearm prevents extraction of the shaft from the barrel of the firearm, effectively locking the firearm against use. With the lock in this lock condition, translation of the rod toward the proximate end results in the flexure pawl no longer engaging the greater diameter portion of the rod. Engagement of the pawl with the portion of the rod of lesser diameter allows the pawl retract to be again flush with the surface of the shaft so as to no longer engage in a ridge in the firearm. In this configuration the distal end and shaft may be withdrawn from the barrel of the firearm allowing normal use.

In another embodiment, actuation of the lock (produced by user actuation) causes the rod within the hollow shaft to rotate between the lock and unlock conditions. The distal end of the rod has an oval cross-section having a major and minor axis. At the distal end the rod supports two tabs, each extending less than 180° about the rod and held in engagement with the surface of the rod by a garter like spring. In the unlock condition the tabs engage with the minor axis of the rod. With the tabs engaged with the minor axis of the rod, the surface of the tabs is co-extensive with the surface of the hollow shaft. When the rod rotates about 90° the tabs come into engagement with the major axis. As a result of engagement with the major axis the tabs move away from the centerline of the rod. That motion causes the surfaces of each of the tabs to extend beyond the surface of the hollow shaft and engage with the interior ridge of the firearm. The engagement of the tabs and ridge prevent withdrawal of the shaft and prevents normal use of the firearm. With the lock in this lock condition rotation of the rod by another 90° allows the tabs to again engage with the minor axis of the rod so the tabs retract to lie flush with the surface of the hollow shaft and disengage with the ridge in the firearm allowing the shaft to be withdrawn so the firearm is again in condition for normal use.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
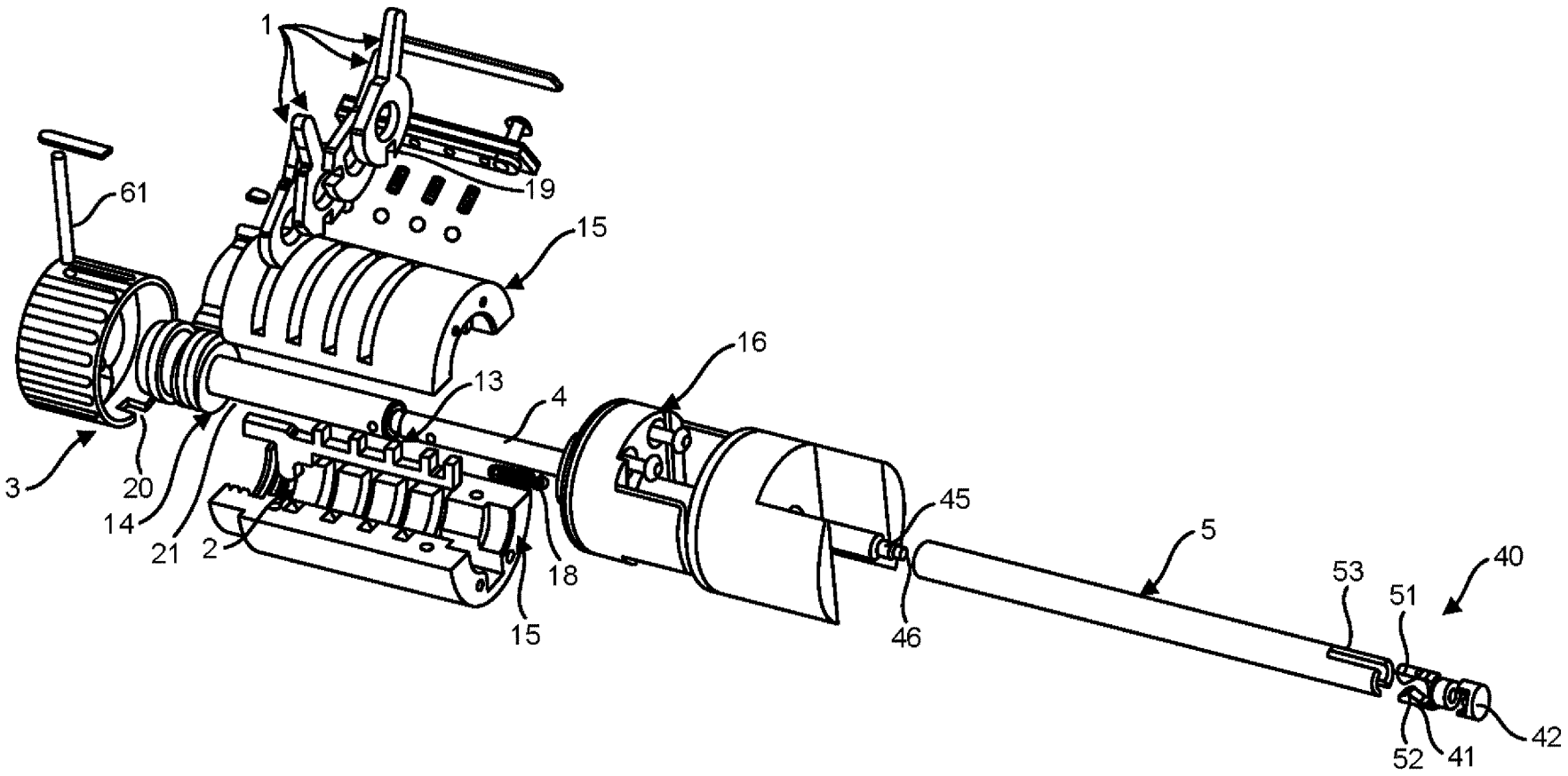
FIG. 1 is an exploded view of one embodiment of the invention.

FIG. 1 is an exploded view of a first embodiment of the invention. At a proximal end are two half base housings 15. The housings 15 are pinned and fused with attachment to the base receiver cap 16. Contained within the housings 15 are a set of four cams 1, each of which can rotate on the linear actuating spindle 14. Each cam 1 has a notch 19 which establishes a coded position for that cam. When all four cams 1 are in their coded position, each of the notches 19 will register so that a comb 13 is allowed to translate. A knob 3 is pressed onto the spindle 14 and pinned by the pin 51. A spring release tab 2 is fixed to the comb 13 and a spring 18 is attached to the comb 13 and the housing 16 to provide a force to stabilize the tab 2 within the notch 20 to stabilize the knob 3 against motion.

Figure 2:
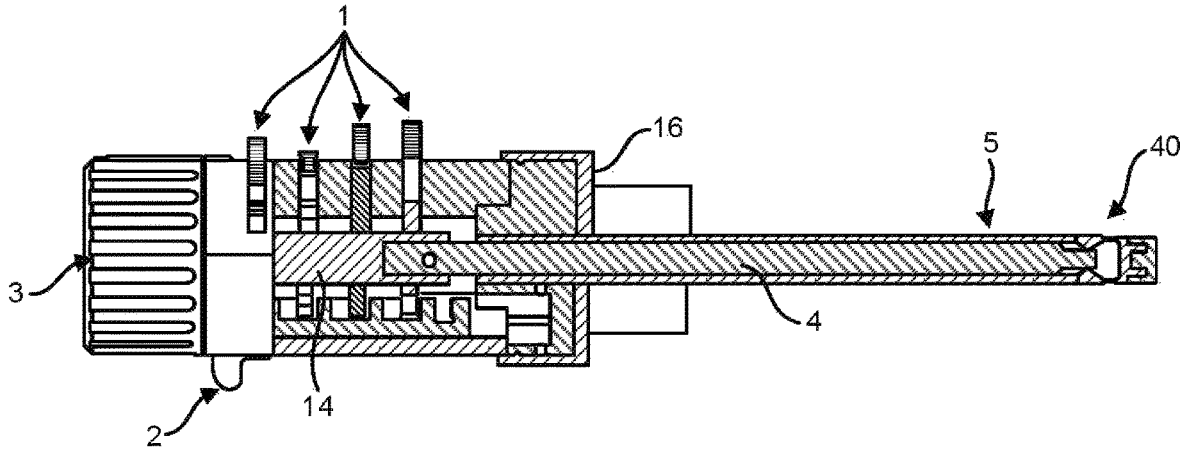
FIG. 2 is a cross-section of the device of FIG. 1.

When the cams 1 achieve their coded condition and the comb is free to translate the user may apply a force to withdraw the tab 2 from the notch 20. When the tab 2 is withdrawn from notch 20 the knob 3 is free to rotate in response to user actuation. Rotation of the knob 3 produces rotation of the spindle 14. The presence of the threads on the spindle 14 produce translation of the shaft 21 from rotation of the spindle 14. Located within the shaft 21 is the translation shaft or rod 4 which can translate forward (away from knob 3) and back (towards the knob 3) in response to translation of the shaft 21. FIG. 2 is a section of apparatus of FIG. 1 showing the relation of spindle 14 and shaft or rod 4 within the shaft housing 5. At the distal end 40 of the translation shaft or rod 4 is the pawl 41, shown in greater detail in FIG. 4.

Figure 4:
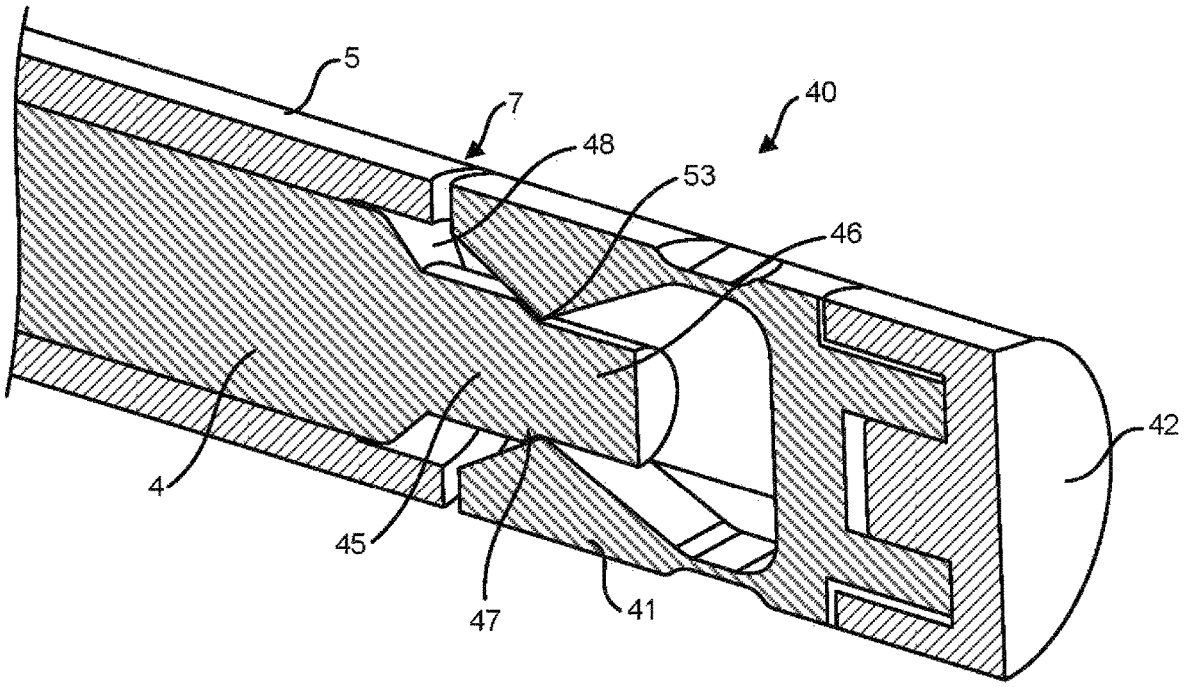
FIG. 4 is a cross-section of the distal end of the device of FIG. 1 in an unlock condition.
Figure 5:
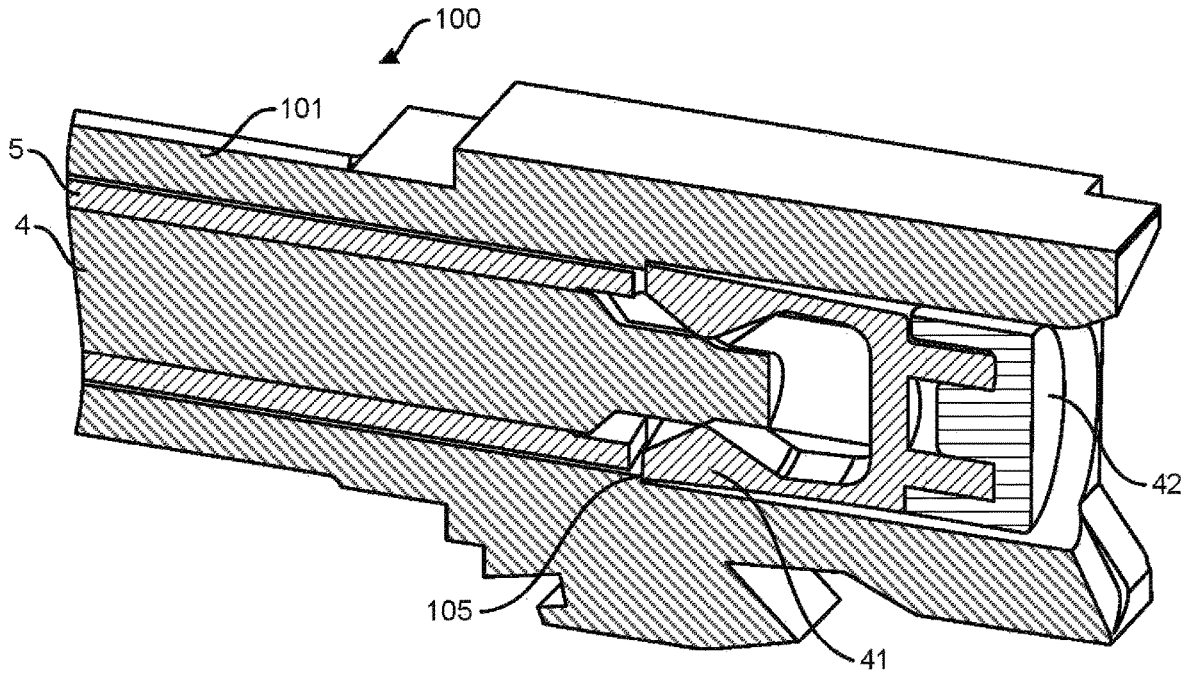
FIG. 5 is a cross-section of a firearm and located therein the distal end of the device of FIG. 1 in a lock condition.

The pawl 41 fits into the end cap 42. The end cap 42 is the leading end of the lock to enter the barrel. The end cap 42 is made of resilient material that is less hardened than the barrel so that introduction of the lock into the firearm is not detrimental to the firearm. As seen in FIGS. 1 and 4, the distal end of the translation shaft 4 has a first reduced region 45 and a second reduced region 46. Each of the reduced regions 45 and 46 has a diameter smaller than the upstream region so that (see FIG. 4) the translation shaft 4 exhibits a first shoulder 48 (between the translation shaft 4 and first reduced region 45) and a second shoulder 47 between the first and second reduced regions 45 and 46. The flexure pawl 41 has a pair of wings 51-52 which fit within a slot 53 in the tubular surface of the shaft housing 5. The interior of each of the wings 51, 52 has a diameter which first reduces to a minimum and then increases at increasing distances from the proximal edge of the wing toward the distal end producing an edge 53 of the smallest diameter. When the translation shaft 4 translates toward the distal end the edge 53 first intersects shoulder 47 and then rides up the shoulder 47. As a consequence, the surfaces of wings 51 and 52 jut above the surface of the shaft housing 5. When inserted in the barrel of a firearm (see FIG. 5) the distal end of the lock extends through the barrel 101 and into the chamber of the firearm. The chamber of the firearm and barrel intersect in the edge 105. When the lock is inserted into the chamber of the firearm in an unlock condition (translation shaft 4 in the retracted position), and thereafter transitioned to a lock condition (by motion of the tab 2 and rotation of the knob 3), the surface of the wings 51, 52 jut above the surface of shaft 5 and intersect with the edge 105 of the firearm. Thereafter, the comb 2 is retracted so the tab is again inserted into the slot 20 in the knob 3. In this condition the lock cannot be withdrawn and the firearm is incapable of discharging. To transition the lock to the unlock condition, the cams must again be positioned into their coded position so the comb 13 can be shifted forward allowing the tab 2 to be withdrawn from the slot 20 in the knob 3. This frees the knob 3 to rotate to translate the shaft 4 backward (toward the proximal position) moving the edge 53 past the shoulder 47 retracting the wings 51, 52 from intersecting the edge 105 allowing the lock to be withdrawn from the firearm.

Figure 6:
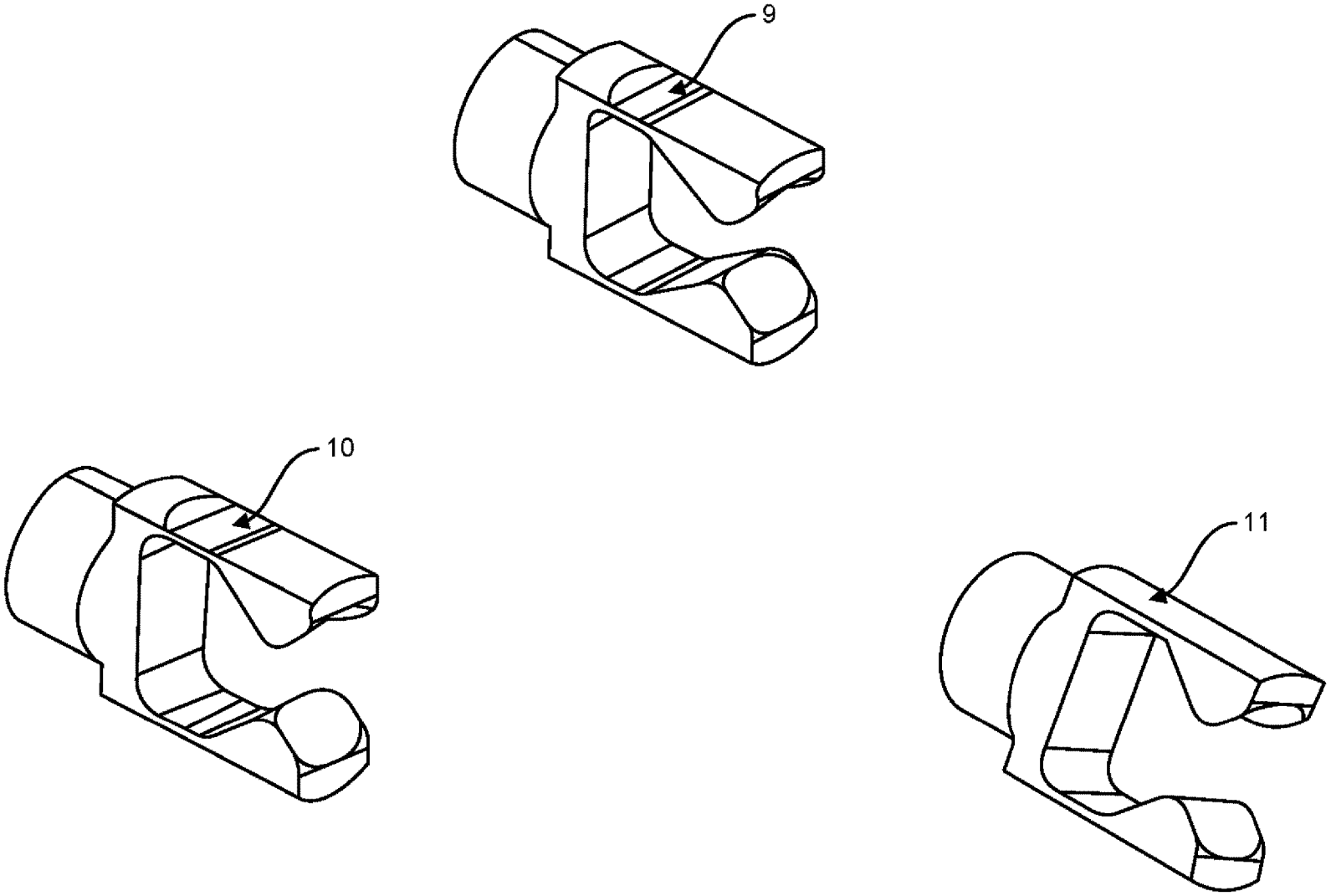
FIG. 6 shows variations on the flexure element of the device of FIG. 1.

The pawl 41 has wings 51 and 52 which present a continuous surface that is flush with the shaft housing 5 when the wings 51, 52 are withdrawn into an unlock condition. The form of the pawl illustrated in FIGS. 1-5 can be changed to any of the forms 9-11 illustrated in FIG. 6. Different shapes illustrated in FIG. 6 are accompanied by different force levels which are required to deploy the wings outwardly from the unlock to the lock condition. The pawl can be made from stainless steel, optimally a 17-4 PH or 17-7 PH and can be made with varying spring flexure lengths and thicknesses as illustrated in FIG. 6. In particular the forms represented at 9 and 10 each include back relied. The back relief at 10 represents a longer spring section than that referenced at 9. The longer spring section reduces the force required of the translation shaft or rod 4 to deploy the two pawls. The form of the pawl represented at 11 does not include any back relief at all. The absence of back relief requires more force to achieve the transitional movement. Consequently, the sequence of the forms 11, 9 and 10 represent a sequence of reduced force required to achieve the transitional movement.

Figure 7:
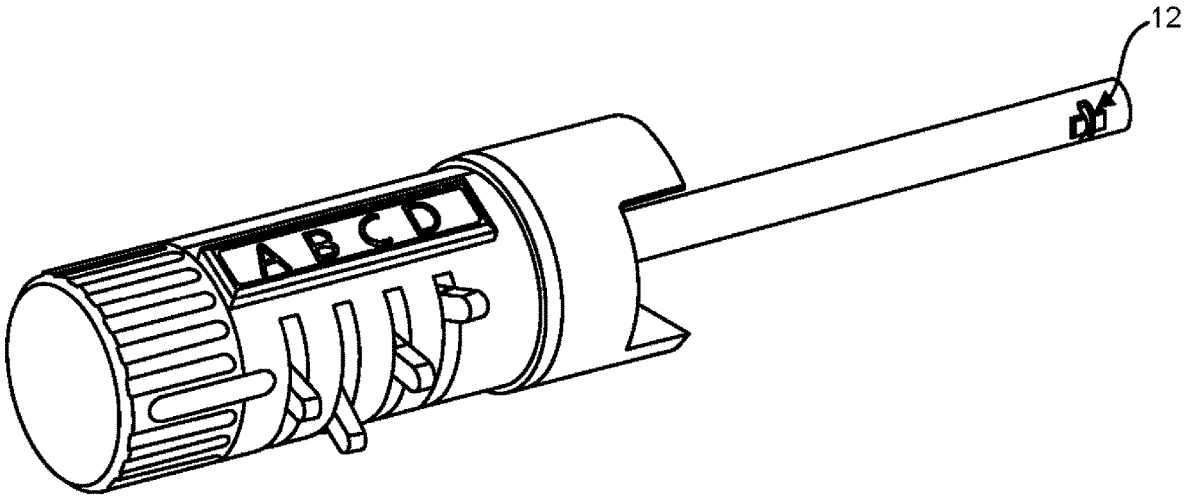
FIG. 7 is a perspective view of another embodiment of the invention.
Figure 8:
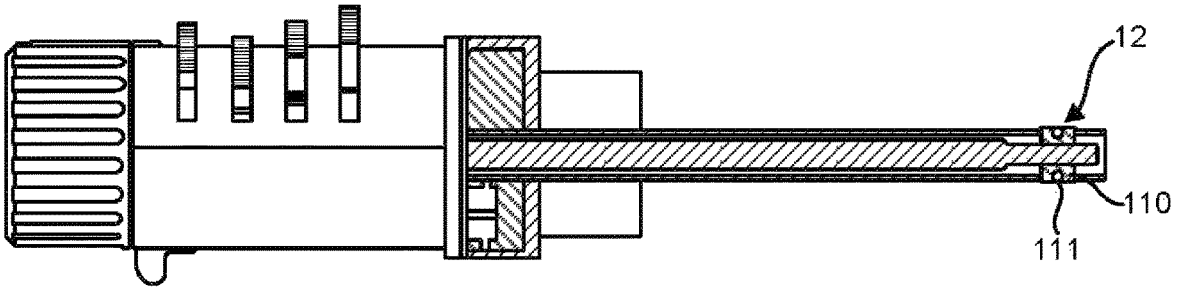
FIG. 8 is a cross-section of the device of FIG. 7.
Figure 9:
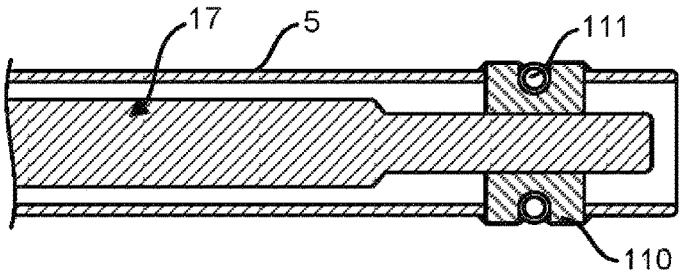
FIG. 9 is a cross-section of the distal end of the device of FIG. 7.
Figure 10:
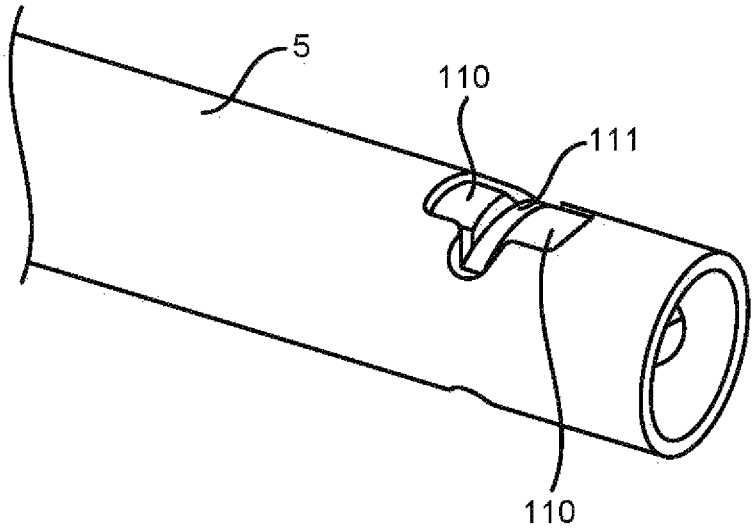
FIGS. 10 and 11 are perspective and section of the distal end of the device of FIG. 7 in the unlock condition.
Figure 11:
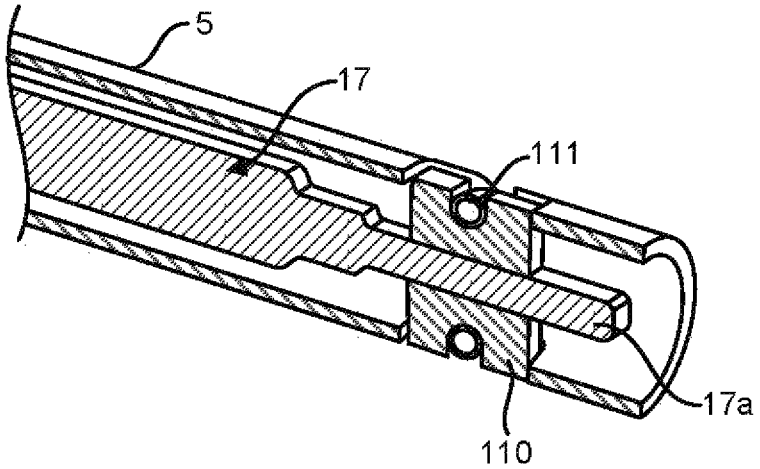
Figure 12:
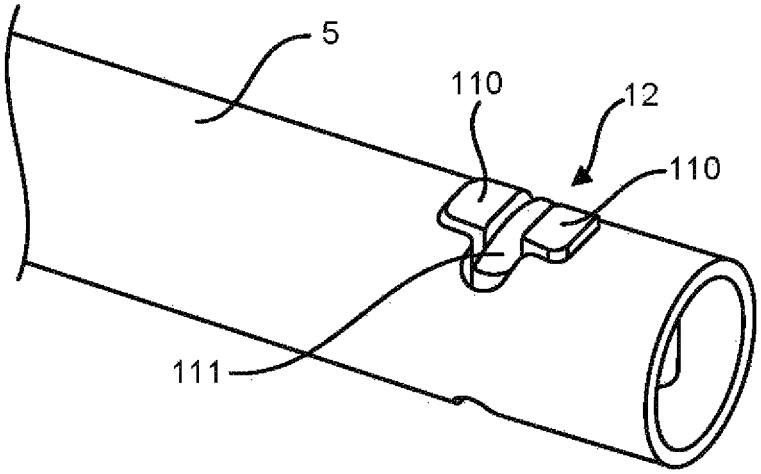
FIGS. 12 and 13 are perspective and section of the distal end of the device of FIG. 7 in the lock condition.
Figure 13:
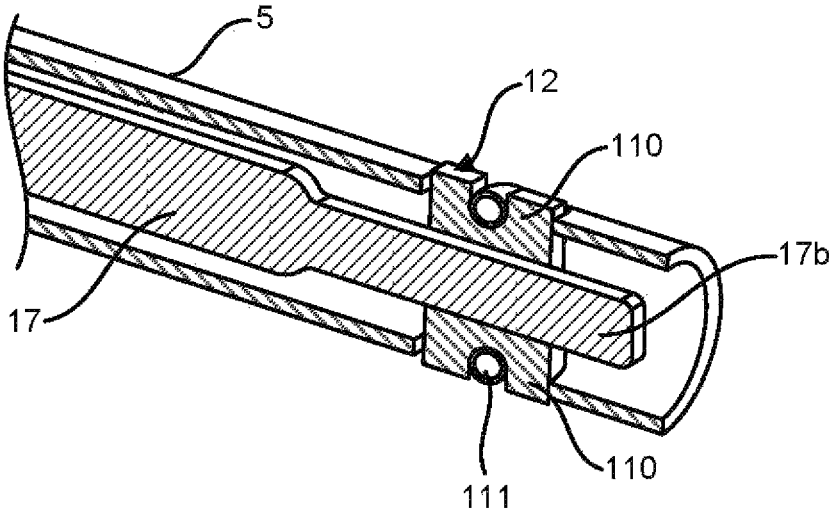

A second embodiment is illustrated in FIGS. 7-13. The embodiment of FIG. 1 operates between the lock and unlock condition by translation of the shaft 4. The embodiment of FIG. 7 has a similar shaft which is fixed and released by the use of cams 1-4, knob 3, comb 13 having tab 2 interacting with slot 20 just as the embodiment of FIG. 1. However, shaft 4 of FIG. 1 is replaced by shaft 17 and the flexure pawl 41 is replaced by pawl 12. Shaft 17 operates the pawl 12 between a lock and unlock condition by rotation of the shaft 17. In other words, with the cams 1-4 in their coded positions, the comb 13 is free to move forward freeing the tab 2 allowing knob 3 to rotate. Rotation of knob 3 causes spindle 14 to rotate. In the embodiment of FIG. 7 rotation of spindle 21 produces rotation of shaft 17. As seen in the section of FIGS. 8 and 9 the pawl 12 includes two segments, 110, each secured about the shaft 17 by a spring 111. The shaft 17 has an oval cross section—compare FIGS. 11 and 13. In FIG. 11 (showing the unlock or retracted condition) the segments 110 fit around the shaft 17 separated by a minor axis of the oval. In FIG. 12 the segments 110 are separated by the major axis of the oval. When the segments 110 are separated by the minor axis of the oval the outer surface of the segments are colinear with the surface of the housing 5. On the other hand the increased length of the major axis of the oval is such that when the segments surround the major axis (as seen in FIGS. 12 and 13, the surface of the segments 110 protrude beyond the surface of the housing 5 to such an extent that the segments impact the edge 105 at the intersection of barrel and chamber of the firearm. If, at this time the lock is inserted into the chamber and locked with the major axis of the shaft 17 separating the segments 110, then the segments will prevent the segments from passing the edge 105, i.e., the lock cannot be withdrawn from the firearm and so the firearm cannot be discharged. If the tab 2 is moved out of the slot 20 and the knob rotated so the minor axis of the shaft 17 separates the segments 110, then the surface of the segments will retract to lie colinear with the surface of the housing 5 allowing the segments to pass the intersection of the barrel and chamber and allowing the lock to be withdrawn from the firearm.

The pawl design represented in FIGS. 10-13 show how two independent elements can be held together by a spring and actuated by a rotary cam mechanism (the shaft 17).

Figure 3:
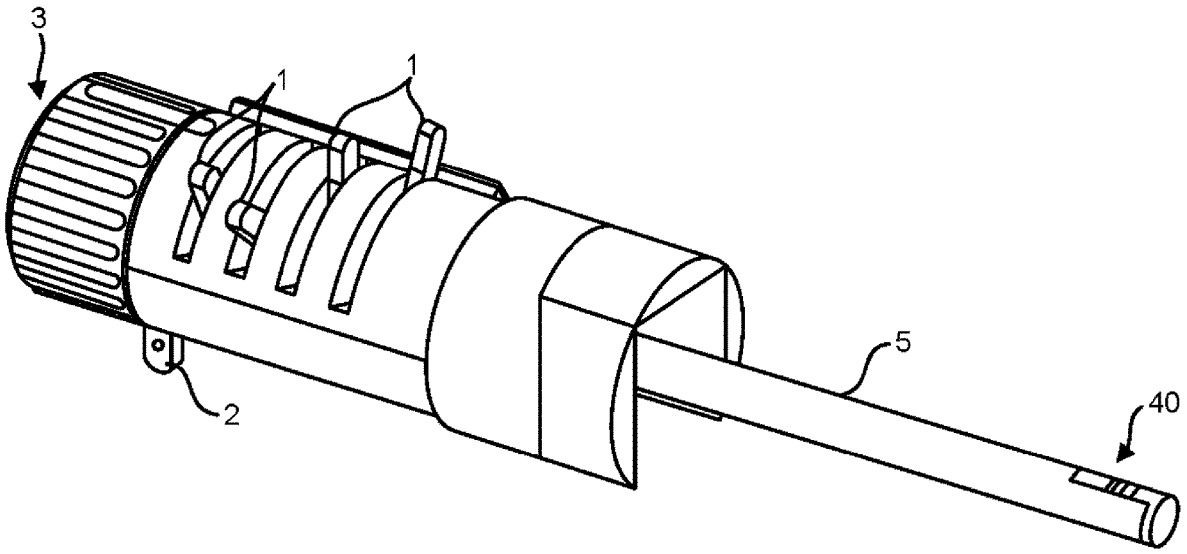
FIG. 3 is a perspective view of the device of FIG. 1.
Figure 14:
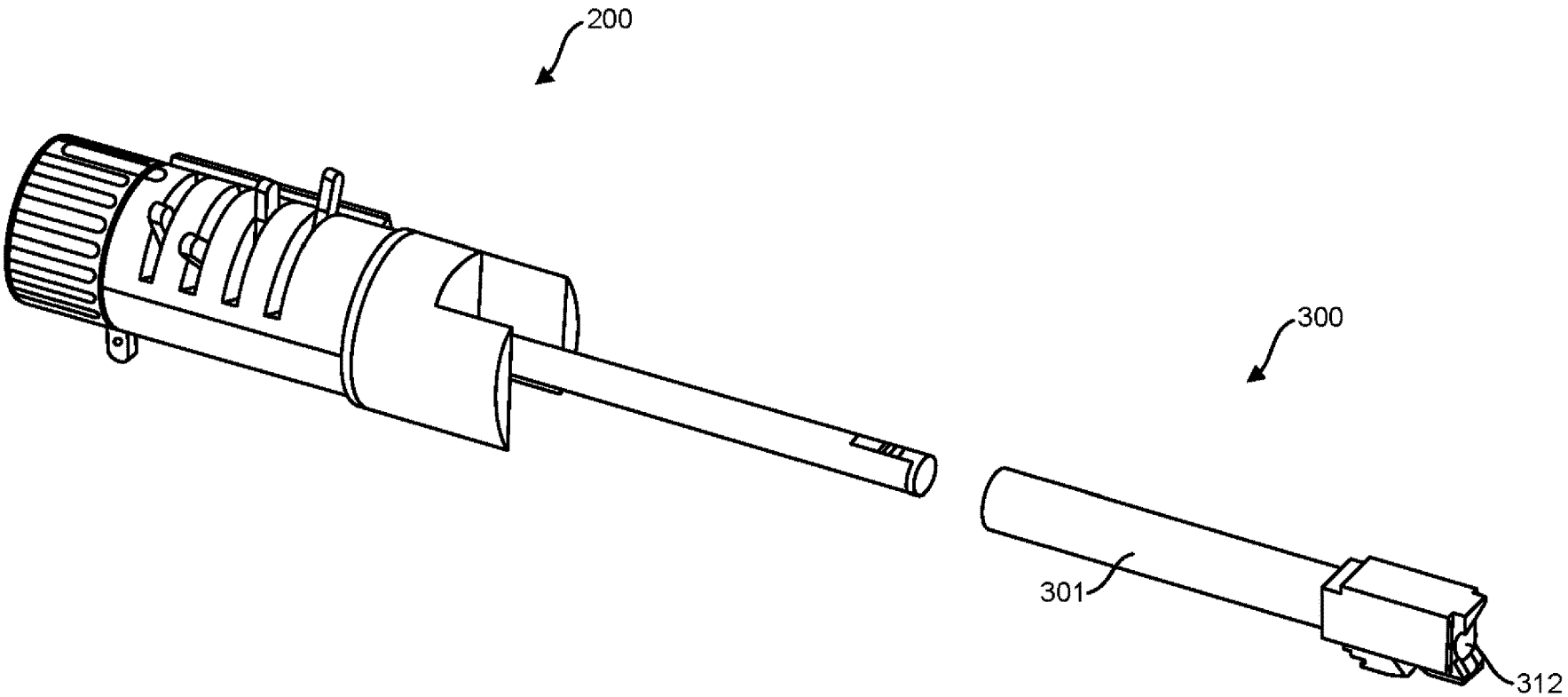
FIG. 14 show a typical gun lock according to one embodiment juxtaposed to a typical firearm.
Figure 15:
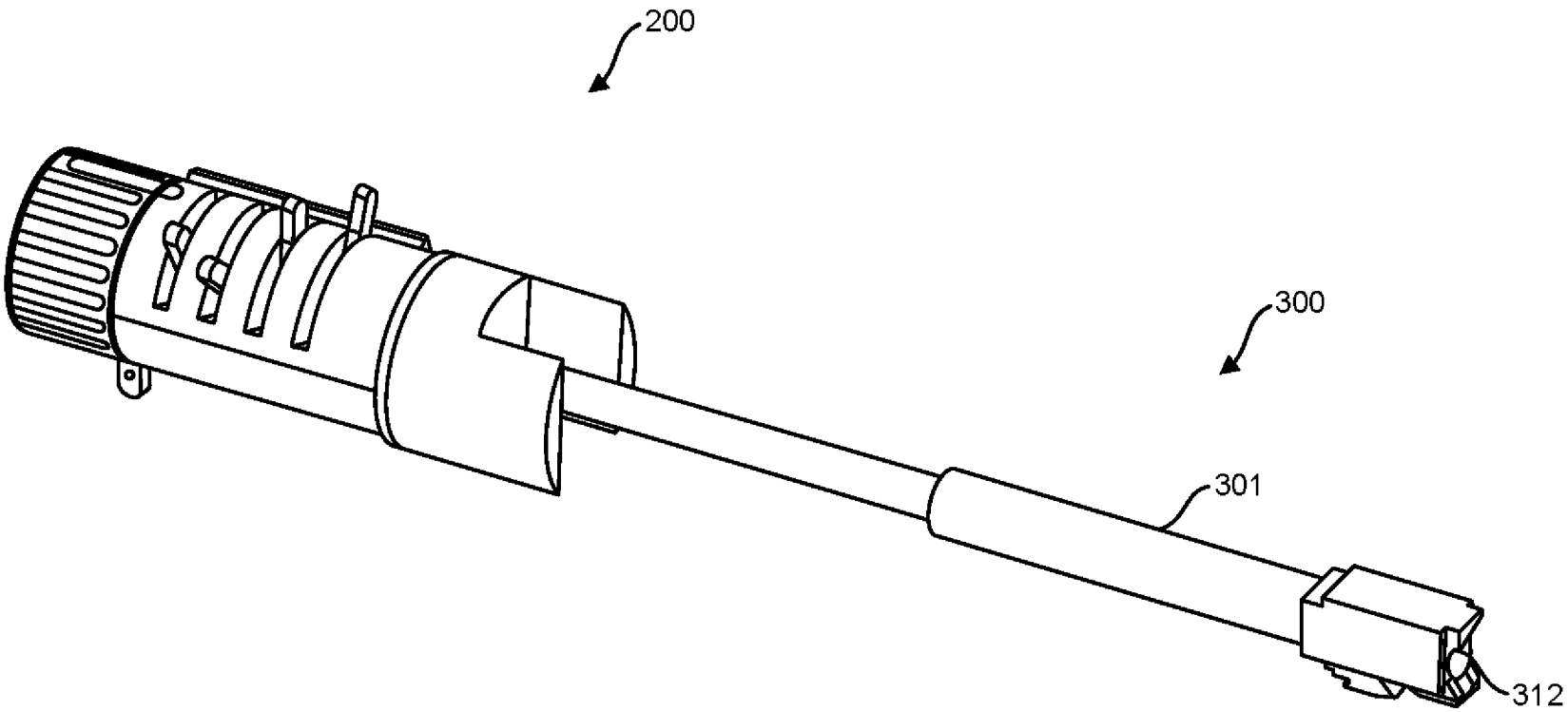
FIG. 15 shows a typical gun lock according to the invention inserted in a firearm.

FIGS. 14 and 15 illustrate a typical gun lock 200 (which can represent either the gun lock of FIGS. 1-3 or the gun lock of FIGS. 7-13). FIG. 14 shows the gun lock 200 adjacent but not inserted into the firearm 300 whereas FIG. 15 shows the gun lock 200 inserted into the firearm 300.

The foregoing is a description of two specific embodiments of the invention but it is apparent that many variations may be made within the spirit and scope of the invention which is expressed within the scope of the attached claims.

What is claimed is:

1. A locking device in combination with a firearm having a barrel with a muzzle, a bore in the barrel with a first diameter, and a chamber wall that defines a chamber of said firearm with a second diameter larger than the first diameter, the combination comprising:

a hollow tube adapted to fit coaxially within the bore, the tube having a proximal end portion, a distal end portion, and a length sufficient to extend from the muzzle to the chamber;

a first subassembly on the distal end portion of the tube that is adapted to be moved under user control between a first configuration that fits within the bore so that the first subassembly does not obstruct removal of the tube from the bore, and a second configuration of the first subassembly that fits within the chamber but does not fit within the bore so that the first subassembly does obstruct removal of the tube from the bore;

a second subassembly connected to the proximal end of the tube for enabling a user to selectively move the first subassembly between the first and second configurations while the tube is within the bore, the second subassembly including an actuator knob adapted to be rotated manually between a first position of the actuator knob corresponding to the first subassembly being in the first configuration and a second position of the actuator knob corresponding to the first subassembly being in the second configuration, the second subassembly including means for locking the actuator knob in the second position; and a rod disposed coaxially within the tube to serve as means for coupling movement from the second subassembly to the first subassembly when the actuator knob is rotated to the second position;

the first subassembly including a plurality of slots in said hollow tube, and at least one component with a receiving surface, the component including at least one element located adjacent one of said slots which may radially move outward in response to an applied force from the rod to the receiving surface;

the second subassembly including means responsive to movement of the actuator knob from the first position to the second position to urge the rod to bear against and move the receiving surface to force the displacement outwards of the element, wherein the means for coupling movement from the second subassembly to the first subassembly rotates the rod in place responsive to rotation of the actuator knob to achieve movement of the first subassembly from the first configuration to the second configuration.

2. The locking device in combination with a firearm as recited in claim 1 in which the first subassembly includes at least two tabs secured into contact with said rod by a circumferentially extending spring.

3. A locking device for a firearm having a barrel with a muzzle, a bore in the barrel with a first diameter, and a chamber wall that defines a chamber of said firearm with a second diameter larger than the first diameter, the device comprising:

a hollow tube adapted to fit coaxially within the bore, the tube having a proximal end portion, a distal end portion, and a length sufficient to extend from the muzzle to the chamber;

a first subassembly on the distal end portion of the tube that is adapted to be moved under user control between a first configuration that fits within the bore so that the first subassembly does not obstruct removal of the tube from the bore, and a second configuration of the first subassembly that fits within the chamber but does not fit within the bore so that the first subassembly does obstruct removal of the tube from the bore;

a second subassembly connected to the proximal end of the tube for enabling a user to selectively move the first subassembly between the first and second configurations while the tube is within the bore, the second subassembly including an actuator knob adapted to be rotated manually between a first position of the actuator knob corresponding to the first subassembly being in the first configuration and a second position of the actuator knob corresponding to the first subassembly being in the second configuration, the second subassembly including means for locking the actuator knob in the second position; and a rod disposed coaxially within the tube to serve as means for coupling movement from the second subassembly to the first subassembly when the actuator knob is rotated to the second position;

the first subassembly including a plurality of slots in said hollow tube, and at least one component with a receiving surface, the component including at least one element located adjacent one of said slots which may radially move outward in response to an applied force from the rod to the receiving surface;

the second subassembly including means responsive to movement of the actuator knob from the first position to the second position to urge the rod to bear against and move the receiving surface to force the displacement outwards of the element, wherein the means for coupling movement from the second subassembly to the first subassembly rotates the rod in place responsive to rotation of the actuator knob to achieve movement of the first subassembly from the first configuration to the second configuration.

4. The locking device for a firearm as recited in claim 3 in which the first subassembly includes at least two tabs secured into contact with said rod by a circumferentially extending spring.

5. A locking device in combination with a firearm having a barrel with a muzzle, a bore in the barrel with a first diameter, and a chamber wall that defines a chamber of said firearm with a second diameter larger than the first diameter, the combination comprising:

a hollow tube adapted to fit coaxially within the bore, the tube having a proximal end portion, a distal end portion, and a length sufficient to extend from the muzzle to the chamber;

a first subassembly on the distal end portion of the tube that is adapted to be moved under user control between a first configuration that fits within the bore so that the first subassembly does not obstruct removal of the tube from the bore, and a second configuration of the first subassembly that fits within the chamber but does not fit within the bore so that the first subassembly does obstruct removal of the tube from the bore;

a second subassembly connected to the proximal end of the tube for enabling a user to selectively move the first subassembly between the first and second configurations while the tube is within the bore, the second subassembly including an actuator knob adapted to be rotated manually between a first position of the actuator knob corresponding to the first subassembly being in the first configuration and a second position of the actuator knob corresponding to the first subassembly being in the second configuration, the second subassembly including means for locking the actuator knob in the second position; and a rod disposed coaxially within the tube to serve as means for coupling movement from the second subassembly to the first subassembly when the actuator knob is rotated to the second position;

the first subassembly including a plurality of slots in said hollow tube, and at least one component with a receiving surface, the component including at least one element located adjacent one of said slots which may radially move outward in response to an applied force from the rod to the receiving surface;

the second subassembly including means responsive to movement of the actuator knob from the first position to the second position to urge the rod to bear against and move the receiving surface to force the displacement outwards of the element, wherein the at least one element is a flexure pawl.

6. The locking device in combination with a firearm as recited in claim 5 wherein the flexure pawl includes a region of back relief.

7. The locking device in combination with a firearm as recited in claim 5 wherein the flexure pawl does not include a region of back relief.

8. A locking device for a firearm having a barrel with a muzzle, a bore in the barrel with a first diameter, and a chamber wall that defines a chamber of said firearm with a second diameter larger than the first diameter, the device comprising:

a hollow tube adapted to fit coaxially within the bore, the tube having a proximal end portion, a distal end portion, and a length sufficient to extend from the muzzle to the chamber;

a first subassembly on the distal end portion of the tube that is adapted to be moved under user control between a first configuration that fits within the bore so that the first subassembly does not obstruct removal of the tube from the bore, and a second configuration of the first subassembly that fits within the chamber but does not fit within the bore so that the first subassembly does obstruct removal of the tube from the bore;

a second subassembly connected to the proximal end of the tube for enabling a user to selectively move the first subassembly between the first and second configurations while the tube is within the bore, the second subassembly including an actuator knob adapted to be rotated manually between a first position of the actuator knob corresponding to the first subassembly being in the first configuration and a second position of the actuator knob corresponding to the first subassembly being in the second configuration, the second subassembly including means for locking the actuator knob in the second position; and a rod disposed coaxially within the tube to serve as means for coupling movement from the second subassembly to the first subassembly when the actuator knob is rotated to the second position;

the first subassembly including a plurality of slots in said hollow tube, and at least one component with a receiving surface, the component including at least one element located adjacent one of said slots which may radially move outward in response to an applied force from the rod to the receiving surface;

the second subassembly including means responsive to movement of the actuator knob from the first position to the second position to urge the rod to bear against and move the receiving surface to force the displacement outwards of the element, wherein the at least one element is a flexure pawl.

9. The locking device for a firearm as recited in claim 8 wherein the flexure pawl includes a region of back relief.

10. The locking device for a firearm as recited in claim 8 wherein the flexure pawl does not include a region of back relief.

* * * * *